United States Patent [19]

Hirschfeld et al.

[11] 4,116,724

[45] Sep. 26, 1978

[54] METHOD OF HEAT TREATING COBALT-CHROMIUM-MOLYBDENUM BASED ALLOY AND PRODUCT

[75] Inventors: Dieter Hirschfeld; Manfred Müller, both of Essen, Fed. Rep. of Germany

[73] Assignee: Fried. Krupp Gesellschaft mit beschrankter Haftung, Essen, Fed. Rep. of Germany

[21] Appl. No.: 795,526

[22] Filed: May 10, 1977

[30] Foreign Application Priority Data

May 15, 1976 [DE] Fed. Rep. of Germany ..... 2621789

[51] Int. Cl.[2] ..... C22F 1/10

[52] U.S. Cl. ..... 148/3; 75/171; 148/13; 148/20.3; 148/32; 148/32.5; 148/158

[58] Field of Search ..... 75/171, 170; 148/32, 148/32.5, 13, 20.3, 158, 3

[56] References Cited

U.S. PATENT DOCUMENTS 3,865,585 2/1975 Rademacher ..... 75/171

*Primary Examiner*—R. Dean

*Attorney, Agent, or Firm*—Spencer & Kaye

[57] ABSTRACT

A casting alloy consisting essentially of 20 to 40% chromium, 2 to 12% molybdenum, up to 2% silicon, up to 5% manganese, up to 1% carbon, 0.1 to 1% nitrogen, and the remainder cobalt and the usual impurities inherent to the manufacturing process. The alloy is subjected to a heat treatment to homogenize the lattice of the alloy, and thereafter the alloy is rapidly quenched in order to prevent reformation of deposits in the lattice.

10 Claims, No Drawings

METHOD OF HEAT TREATING COBALT-CHROMIUM-MOLYBDENUM BASED ALLOY AND PRODUCT

BACKGROUND OF THE INVENTION

The present invention relates to a casting alloy of cobalt, chromium and molybdenum and containing up to 2% silicon, up to 5% manganese, and up to 1% carbon, to be used for surgical and dental prostheses.

It is state of the art to use stainless steels, Co-Cr-Mo alloys, Co-Cr-W-Ni alloys, unalloyed titanium or Ti-Al-V alloys as the metallic material for surgical implants. For dental prostheses, the above mentioned Co-Cr-Mo alloys as well as Co-Cr-Ni-Mo alloys and Co-Ti-Cr alloys are the most commonly used materials. In addition, noble metals and their alloys can be used for dental prostheses. For use in the human body, all metallic materials must meet high requirements. They should not only have good mechanical properties and particularly good corrosion resistance, but should also be of such composition that under the conditions prevailing in the human body they will not cause toxic tissue reactions. Furthermore, such metallic materials must be easily worked into complicated shapes that conform to the human body and should not be too expensive.

The known metallic materials do not always meet these requirements to a sufficient degree. For example, breaks have occasionally occurred in surgical implants and dental prostheses made of such materials as a result of insufficient ductility and permanent stresses. The onset of corrosion and toxic tissue reactions have also been noted in their use. The use of noble metals is correspondingly costly.

In order to improve the mechanical properties of implant casting alloys on a cobalt-chromium-molybdenum base, it has already been proposed to increase the nitrogen content beyond the amount of nitrogen that is usually present as an impurity, but to limit the total amount of carbon plus nitrogen to 0.7%, as disclosed in German Auslegeschrift No. 2,225,577, corresponding to U.S. Pat. No. 3,865,585. It is also known, as disclosed in Technische Rundschau Sulzer, 1974, pages 235 to 245, that the properties of Fe-Cr-Ni-Mo alloys can be influenced by a suitable heat treatment. Such heat treatment however, has the drawback when used with the conventional alloys of this type, that the improvement in ductility (elongation at rupture) as compared to non-heat treated Co-Cr-Mo alloys disclosed in the Technische Rundschau Sulzer article is connected with a worsening of the strength values, such as the values for 0.2 elastic limit, tensile strength, and hardness as compared to non-heat treated Co-Cr-Mo alloys disclosed in the Technische Rundschau Sulzer article. (Compare Tables 4 and 5 at page 237 of the Technische Rundschau Sulzer article). Similar results were to be expected with nitrogen containing Co-Cr-Mo alloys subjected to heat treatment.

SUMMARY OF THE INVENTION

It is a primary object of the present invention to provide an alloy which meets the requirements for use in medical and dental applications in an improved manner.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, it has surprisingly been found, in accordance with the present invention that, if a heat treatment is used for casting alloys consisting essentially of by weight 20 to 40% Cr, 2 to 12% Mo, up to 2% Si, up to 5% Mn, up to 1% C, 0.1 to 1% N, and remainder cobalt and the usual impurities acquired during manufacture, mechanical properties can be attained which are more favorable than those of the prior art alloys if, after production of the alloy by melting, the alloy is subjected to a heat treatment to homogenize the lattice of the alloy, and the alloy is then rapidly quenched so that reformation of deposits in the lattice is prevented.

Preferably, the heat treatment to homogenize the lattice of the alloy is a solution heat treatment at a temperature of more than 1000° C. It is preferred to effect the solution heat treatment in a protective gas atmosphere. Preferably, the solution heat treatment should take place at temperatures about 1200° C. The quenching may be followed by a reheating at temperature of about 700° C in order to improve the creep strength of the alloy. Advisably, the duration of the solution heat treatment, as well as the reheating step, are each practiced for about one hour.

DESCRIPTION OF PREFERRED EMBODIMENTS

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLES 1 to 11

For example, the alloys shown in the following Table I were subjected to heat treatment according to the invention. The alloys were first molten in an induction furnace and then poured into ceramic molds. After removal of the molds the castings were heat treated in accordance with the invention under a protective atmosphere consisting of argon by heating them and holding them at a temperature of 1200° C for 60 minutes. After this solution heat treatment the castings were quenched in water to room temperature within a few seconds. The quenching may be followed by drawing at temperatures around 800° C for about 1 hour. The castings so treated exhibit the properties indicated in Table II.

TABLE I

| Ex. No. | CHEMICAL COMPOSITION % Mo | % Cr | % Mn | % Si | % C | % N | % Co |
|---|---|---|---|---|---|---|---|
| 1 | 3 | 33 | 1 | 0.85 | 0.20 | 0.25 | Remainder |
| 2 | 4 | 32 | 1 | 0.85 | 0.19 | 0.24 | " |
| 3 | 5 | 31 | 1 | 0.85 | 0.19 | 0.25 | " |
| 4 | 6.75 | 27 | 1 | 0.85 | 0.21 | 0.21 | " |
| 5 | 6.75 | 30 | 1 | 0.85 | 0.20 | 0.23 | " |
| 6 | 6.75 | 31.5 | 1.4 | 0.85 | 0.23 | 0.26 | " |
| 7 | 8 | 24 | 1 | 0.85 | 0.18 | 0.16 | " |
| 8 | 8 | 27 | 1 | 0.85 | 0.19 | 0.20 | " |
| 9 | 9 | 22 | 1 | 0.85 | 0.18 | 0.14 | " |
| 10 | 10 | 20 | 1 | 0.85 | 0.17 | 0.12 | " |
| 11 | 11 | 18 | 1 | 0.85 | 0.18 | 0.10 | " |

TABLE II

| Example Number | MECHANICAL PROPERTIES 0.2 Proof Stress $\sigma_{0.2}$ N/mm² | Tensile Strength $\sigma_B$ N/mm² | Elongation at Rupture $\delta_5$ (%) | Brinell Hardness HB |
|---|---|---|---|---|
| 1 | 680 | 1110 | 30.8 | 285 |
| 2 | 615 | 1030 | 25.0 | 321 |
| 3 | 620 | 1180 | 27.5 | 285 |
| 4 | 635 | 1160 | 33.0 | 310 |
| 5 | 670 | 1180 | 25.0 | 306 |
| 6 | 655 | 1125 | 30.8 | 313 |
| 7 | 645 | 1040 | 18.5 | 317 |
| 8 | 680 | 1100 | 21.7 | 321 |
| 9 | 625 | 980 | 12.5 | 309 |
| 10 | 625 | 1010 | 14.5 | 299 |
| 11 | 590 | 1000 | 14.0 | 309 |

As can be seen from a study of Table II, the use of the present invention achieves approximately the same values for the 0.2 elastic limit as the alloys according to German Auslegeschrift No. 2,225,577, but, with the same elastic limit values, the tensile strengths realized in the alloys of the present invention are clearly better than those of the alloys according to German Auslegeschrift No. 2,225,577. Sensitive electrochemical tests have also shown that the alloys of the composition of the present invention have a high resistance to uniform surface corrosion and pitting after the heat treatment and quenching according to the present invention and, in particular, a high resistance to crevice corrosion, which is desirable for use in medical and dental applications.

The improvements with respect to mechanical properties as well as resistance to corrosion attacks realized in the casting alloys of the above-type after the heat treatment and quenching of the present invention make them also suitable for other purposes in which great strength and corrosion resistance is an important factor.

It will be understood that the above description of the present invention is susceptible to various modifications, changes and adaptations, and the same are intended to be comprehended within the meaning and range of equivalents of the appended claims.

What is claimed is:

1. Cast alloy consisting essentially of by weight 20 to 40% chromium, 2 to 12% molybdenum, up to 2% silicon, up to 5% manganese, up to 1% carbon and 0.1 to 1% nitrogen, remainder cobalt and the usual impurities inherent to the manufacturing process, said alloy having been subjected to a heat treatment to homogenize the lattice of the alloy, and thereafter having been rapidly quenched to prevent reformation of deposits in the lattice.

2. Cast alloy of the composition defined in claim 1 wherein the heat treatment to homogenize the lattice occurs after production of the alloy by melting, said heat treatment being a solution heat treatment at a temperature above 1000° C.

3. Cast alloy of the composition defined in claim 2 wherein the solution heat treatment is effected at a temperature of about 1200° C.

4. Cast alloy of the composition defined in claim 2 wherein the duration of the solution heat treatment is about one hour.

5. Cast alloy of the composition defined in claim 1 wherein the quenching step is followed by reheating at a temperature of about 700° C.

6. Cast alloy of the composition defined in claim 5 wherein the duration of the reheating step is about one hour.

7. Cast alloy of the composition defined in claim 2 wherein the quenching step is followed by reheating at a temperature of about 700° C, and the duration of the solution heat treatment and of the reheating step are each about one hour.

8. A method for heat treating a cast alloy consisting essentially of by weight 20 to 40% chromium, 2 to 12% molybdenum, up to 2% silicon, up to 5% manganese, up to 1% carbon, 0.1 to 1% nitrogen, and the remainder cobalt and the usual impurities inherent to the manufacturing process, comprising: subjecting the alloy to a heat treatment to homogenize the lattice of the alloy, and then rapidly quenching the alloy in order to prevent reformation of deposits in the lattice.

9. The method as defined in claim 8, wherein the heat treatment to homogenize the lattice occurs after production of the alloy by melting, said heat treatment being a solution heat treatment at a temperature above 1000° C.

10. The method as defined in claim 8, wherein the quenching step is followed by reheating at a temperature of about 700° C.

* * * * *